US007013813B2

(12) United States Patent
Lima et al.

(10) Patent No.: US 7,013,813 B2
(45) Date of Patent: Mar. 21, 2006

(54) ADJUSTABLE WORK SURFACE SUPPORT MECHANISM

(75) Inventors: Jose M. Lima, Cambridge (CA); David A. Carter, Cambridge (CA)

(73) Assignee: Baral Holdings Corp., Kitchener (CA)

( * ) Notice: Subject to any disclaimer, the term of this patent is extended or adjusted under 35 U.S.C. 154(b) by 317 days.

(21) Appl. No.: 10/373,715

(22) Filed: Feb. 27, 2003

(65) Prior Publication Data

US 2003/0159759 A1 Aug. 28, 2003

Related U.S. Application Data

(60) Provisional application No. 60/359,666, filed on Feb. 27, 2002, provisional application No. 60/372,417, filed on Apr. 16, 2002.

(51) Int. Cl.
*A47F 5/12* (2006.01)

(52) U.S. Cl. ..... 108/10; 108/72; 248/284.1

(58) Field of Classification Search ..... 108/95, 108/96, 106, 71, 72, 6–10, 50.01; 248/282.1, 248/283.1, 118.3, 284.1
See application file for complete search history.

(56) References Cited

U.S. PATENT DOCUMENTS

| | | | |
|---|---|---|---|
| 4,496,200 | A | 1/1985 | Hagstrom et al. |
| 4,616,798 | A | 10/1986 | Smeenge et al. |
| 4,625,657 | A | 12/1986 | Little et al. |
| 4,644,875 | A | 2/1987 | Watt |
| 4,653,893 | A | 3/1987 | Nelson |
| 4,691,888 | A | 9/1987 | Cotterill |
| 4,706,919 | A | 11/1987 | Soberalski et al. |
| 4,776,284 | A | 10/1988 | McIntosh |
| 5,031,867 | A | 7/1991 | Cotterill |
| 5,037,054 | A | 8/1991 | McConnell |
| 5,145,136 | A | 9/1992 | McConnell |
| 5,211,367 | A | 5/1993 | Musculus |
| 5,230,298 | A | 7/1993 | Pearce |
| 5,257,767 | A | 11/1993 | McConnell |
| 5,292,097 | A | 3/1994 | Russell |
| 5,398,622 | A | 3/1995 | Lubinskas et al. |
| 5,513,579 | A | 5/1996 | Allan |
| 5,626,323 | A | 5/1997 | Lechman et al. |

(Continued)

FOREIGN PATENT DOCUMENTS

| | | |
|---|---|---|
| CA | 2174345 | 2/1996 |

(Continued)

*Primary Examiner*—Janet M. Wilkens
*Assistant Examiner*—Hanh V. Tran
(74) *Attorney, Agent, or Firm*—Jeffrey W. Wong; Borden Ladner Gervais LLP

(57) ABSTRACT

An adjustable work surface arrangement has a primary work surface, a secondary work surface, a link system, a link brake mechanism arranged to selectably prevent or permit rotation of the first end of the link system, a tilt mechanism mechanically connecting the primary work surface and the secondary work surface and a tilt brake mechanism to selectably prevent or permit tilting of the secondary work surface relative the second end. The link system is pivotably attached at a first end to the primary work surface and at a second end to the secondary work surface, to permit the secondary work surface to be displaced relative the primary work surface. The tilt mechanism connects the primary work surface and the secondary work surface, so that when the first end of the link system is pivoted about a first axis, an angular position of the secondary work surface with respect to the primary work surface is kept substantially constant. The tilt stop mechanism adjustably limits the pivoting of the secondary work surface between end positions.

9 Claims, 9 Drawing Sheets

U.S. PATENT DOCUMENTS

| | | | | | |
|---|---|---|---|---|---|
| 5,653,413 | A | | 8/1997 | Fink | |
| 5,683,064 | A | | 11/1997 | Copeland et al. | |
| 5,685,235 | A | | 11/1997 | Allan | |
| 5,697,303 | A | | 12/1997 | Allan | |
| 5,704,299 | A | * | 1/1998 | Corpuz et al. | 108/50.01 |
| 5,707,034 | A | | 1/1998 | Cotterill | |
| 5,775,657 | A | | 7/1998 | Hung | |
| 5,791,263 | A | | 8/1998 | Watt et al. | |
| 5,823,487 | A | * | 10/1998 | Kirchhoff et al. | 248/284.1 |
| 5,836,560 | A | | 11/1998 | Kaplan et al. | |
| 5,839,373 | A | | 11/1998 | Lin | |
| 5,878,674 | A | | 3/1999 | Allan | |
| 5,924,664 | A | | 7/1999 | Mileos | |
| 5,992,810 | A | | 11/1999 | Crinion et al. | |
| 6,098,935 | A | | 8/2000 | Kaplan et al. | |
| 6,135,404 | A | | 10/2000 | Wisniewski et al. | |
| 6,135,405 | A | * | 10/2000 | Jones et al. | 248/284.1 |
| 6,158,359 | A | | 12/2000 | Allan et al. | |
| 6,227,508 | B1 | * | 5/2001 | Panzarella et al. | 248/276.1 |
| 6,257,538 | B1 | | 7/2001 | Pangborn et al. | |
| 6,296,215 | B1 | * | 10/2001 | McCoy et al. | 248/284.1 |
| 6,488,248 | B1 | | 12/2002 | Watt et al. | |
| 6,565,056 | B1 | | 5/2003 | Lin | |
| 2003/0178541 | A1 | * | 9/2003 | Barber | 248/284.1 |

FOREIGN PATENT DOCUMENTS

| | | | | | |
|---|---|---|---|---|---|
| EP | 592181 | * | 4/1994 | | 312/223.3 |
| EP | 0984712 B1 | | 3/2000 | | |
| WO | WO 93/25117 | * | 12/1993 | | 312/223.3 |
| WO | PCT/CA94/00426 | | 2/1996 | | |
| WO | WO 98/53721 | | 12/1998 | | |

* cited by examiner

ADJUSTABLE WORK SURFACE SUPPORT MECHANISM

REFERENCE TO RELATED APPLICATIONS

This is a formal patent application based on and claiming the benefit of two prior U.S. provisional patent applications, namely Ser. No. 60/359,666 filed Feb. 27, 2002, and No. 60/372,417 filed Apr. 16, 2002.

FIELD OF THE INVENTION

The present invention generally relates to an adjustable support mechanism for mounting a secondary work surface for vertical pivotal movement relative to a primary work surface.

BACKGROUND OF THE INVENTION

Traditional support mechanisms are shown in, for example, U.S. Pat. No. 5,513,579. A perceived disadvantage with the shown construction is the relatively large number of individual parts used, making it expensive to manufacture and assemble.

SUMMARY OF THE INVENTION

It is therefore an object of the invention to provide an adjustable work surface support mechanism which provides a robust support, which can be easily and repeatably pivoted with respect to a primary work surface, while keeping the construction simple and more cost effective to manufacture and assemble.

In the invention, an adjustable work surface arrangement has a primary work surface, a secondary work surface, a link structure or system, connecting the two work surfaces, a link brake mechanism and a grooved disc/cable (wire) loop system. The link structure is attached to the primary work surface at a first end of the link structure and attached to the secondary work surface at a second end of the link structure. The link structure either has a single protruding arm connecting the first and second ends of the link system, or has dual spaced apart arms protruding from the second end of the link structure. The link brake mechanism is arranged to selectably prevent or permit rotation of the first end of the link system as it is held on the primary work surface. The grooved disc/cable loop system has a first disc and a second disc held in rotational cooperation by a cable or wire loop. The first end of the link structure is pivotable about a first axis, to adjust the height position of the secondary work surface relative the primary work surface. The secondary work surface is pivotable about a second axis, to allow tilting of the secondary work surface relative the primary work surface. A tilt brake mechanism is arranged on the secondary work surface, to prevent the tilting of the secondary work surface when the tilt brake mechanism is in an engaged position, and allow tilting of the secondary work surface, when the tilt brake mechanism is in a disengaged position. The first disc is rotatable about the first axis and attached to the first end of the link system to rotate with the first end of the link system. The second disc is rotatable about the second axis and attached to the secondary work surface, so that the second disc rotates when the secondary work surface is tilted. In operation, when the first end of the link system is pivoted about the first axis, the angular position of the secondary work surface with respect to the primary work surface is kept substantially constant by the second disc being rotated by the first disc via the loop. The cable loop is arranged with a certain slack around the second disc, to allow for a controlled amount of tilting of the secondary work surface, when the tilt brake mechanism is disengaged. The amount of slack, compared to a cable loop being looped tight around the second disc, decides the amount of tilting movement possible for the secondary work surface in the following way. When the secondary work surface is tilted, the slack of the cable loop is gradually stretched in the direction of tilting movement, by the cable loop being caught in the groove of the second disc and held by frictional forces, provided the amount of slack is not great enough to not allow any frictional contact between the cable loop and the second disc. When the available amount of slack has been "used up", i.e. the cable is stretched fully in the direction of tilting movement, the cable acts as a stop for further tilting of the secondary work surface in the same direction. A user manipulating the secondary work surface by tilting it, does not exert enough force to actually pull the cable loop over the first disc to cause the first end of the link system to pivot relative the primary work surface. The slack of the cable loop thus acts as a tilt stop in either tilt direction, and is also not dependent upon the pivoting position of the first end of the link system, the tilt stop allows the same angular tilt of the secondary work surface irrespective of the pivotal position of the link system, because the cable loop is rotated together with the first disc and the second disc during pivoting of the first end of the link system.

The arm or arms advantageously has/have a hollow shape, with the loop arranged inside the arm or arms.

The link brake system is advantageously operated using a remote control mechanism, which advantageously is arranged at least partly inside the hollow arm.

The remote control mechanism has a movement transmitting means, which advantageously is arranged inside the hollow arm.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
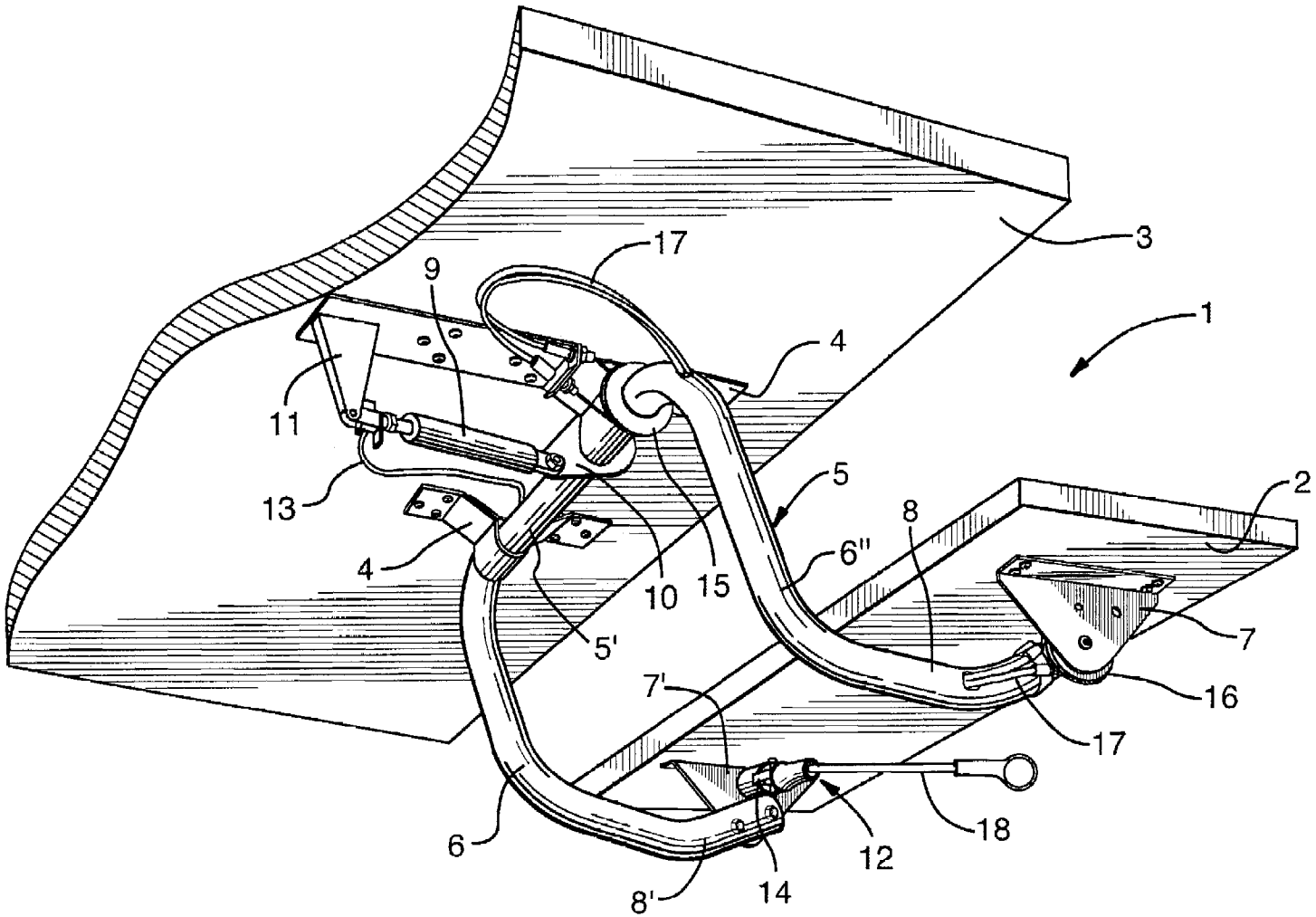
FIG. 1 is a perspective view from below of a support mechanism according to the invention, showing the secondary work surface in an intermediate position.
Figure 2:
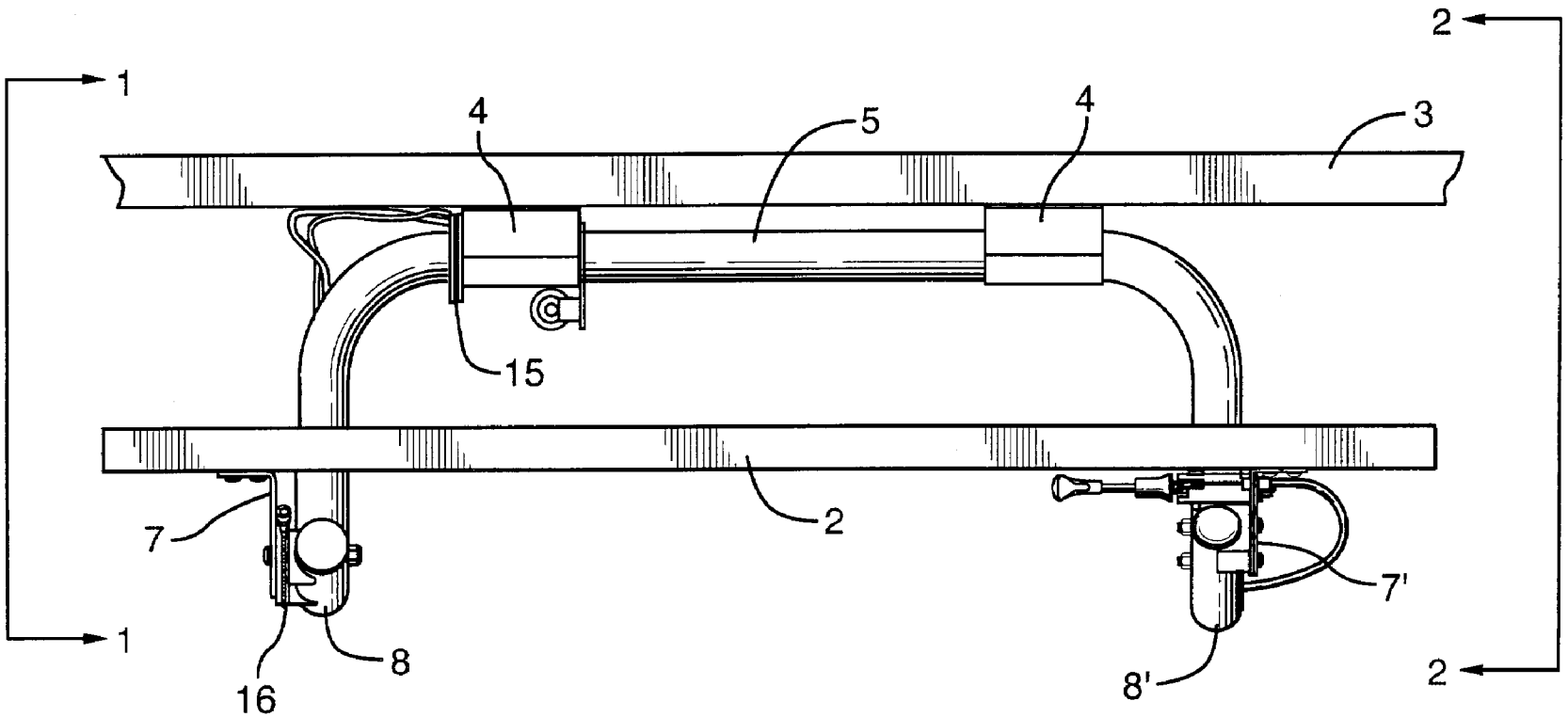
FIG. 2 is a plan view of the support mechanism of FIG. 1 seen from the side of the secondary work surface.
Figure 3:
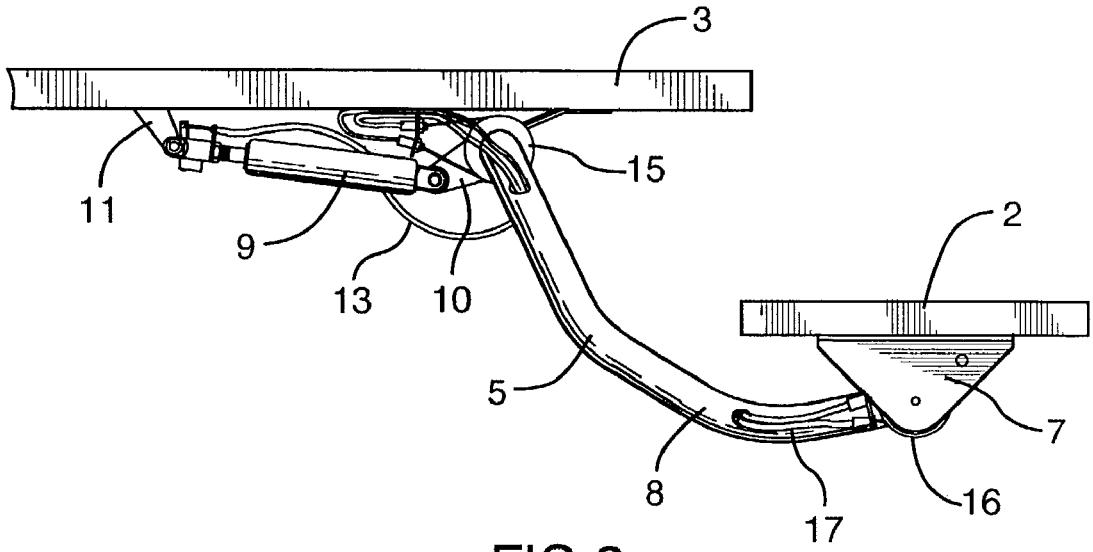
FIG. 3 is an end view of the support mechanism along line 1—1 of FIG. 2.
Figure 4:
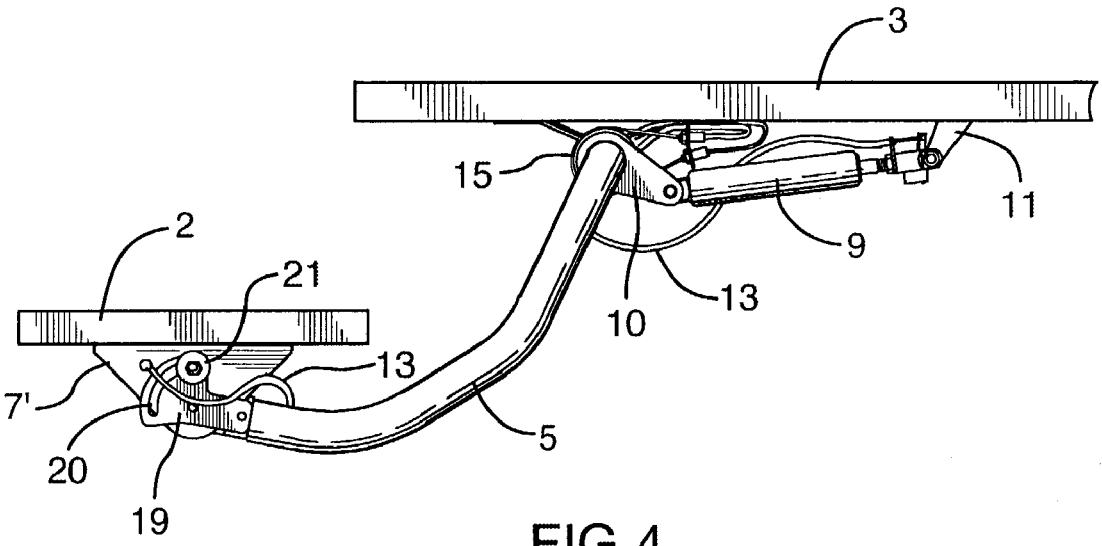
FIG. 4 is an end view of the support mechanism along line 2—2 of FIG. 2.
Figure 5:
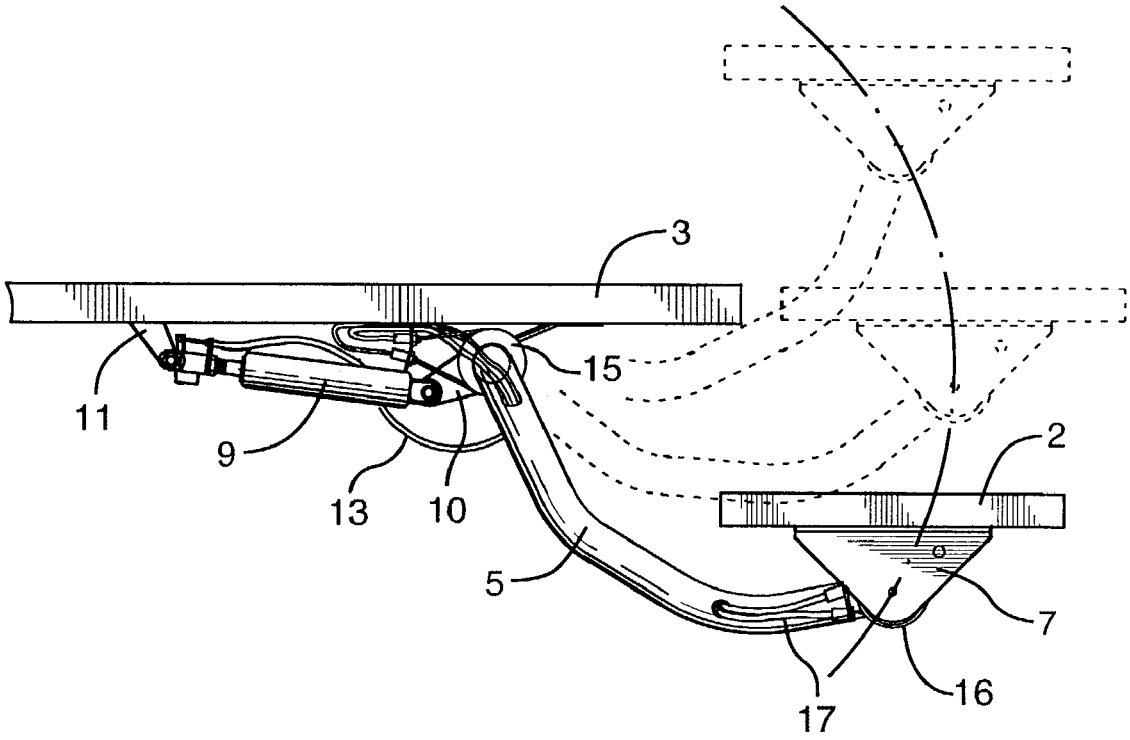
FIG. 5 is an end view of the support mechanism as shown in FIG. 3, further showing the movement of the arm.
Figure 6:
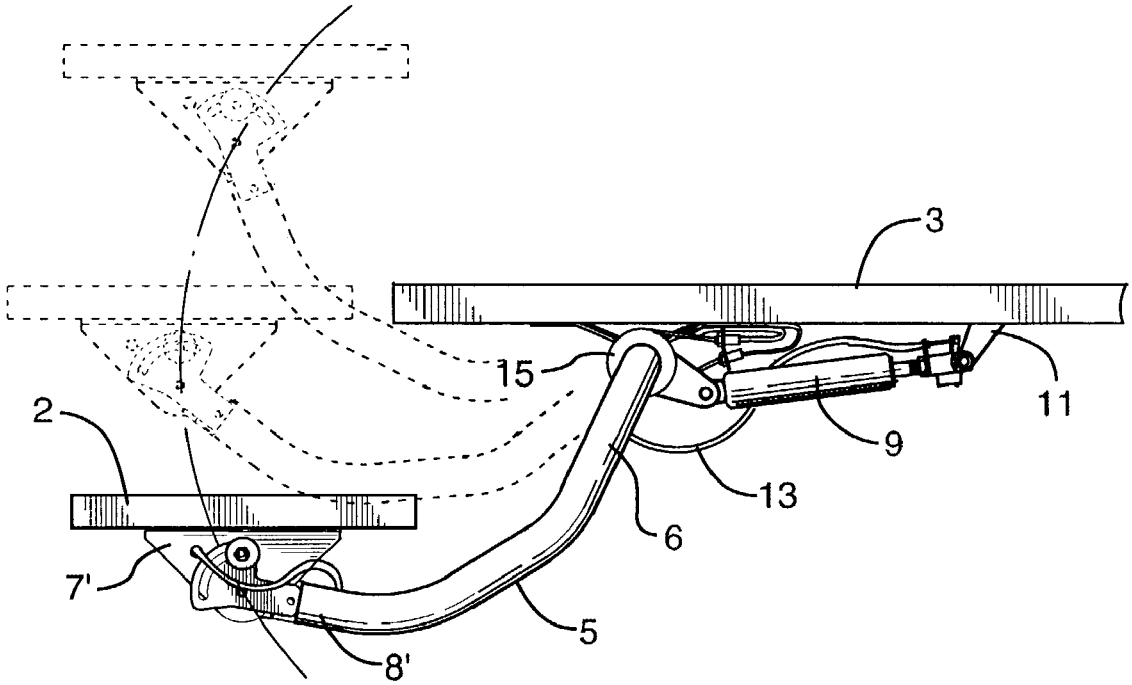
FIG. 6 is an end view of the support mechanism as shown in FIG. 4, further showing the movement of the arm.
Figure 7:
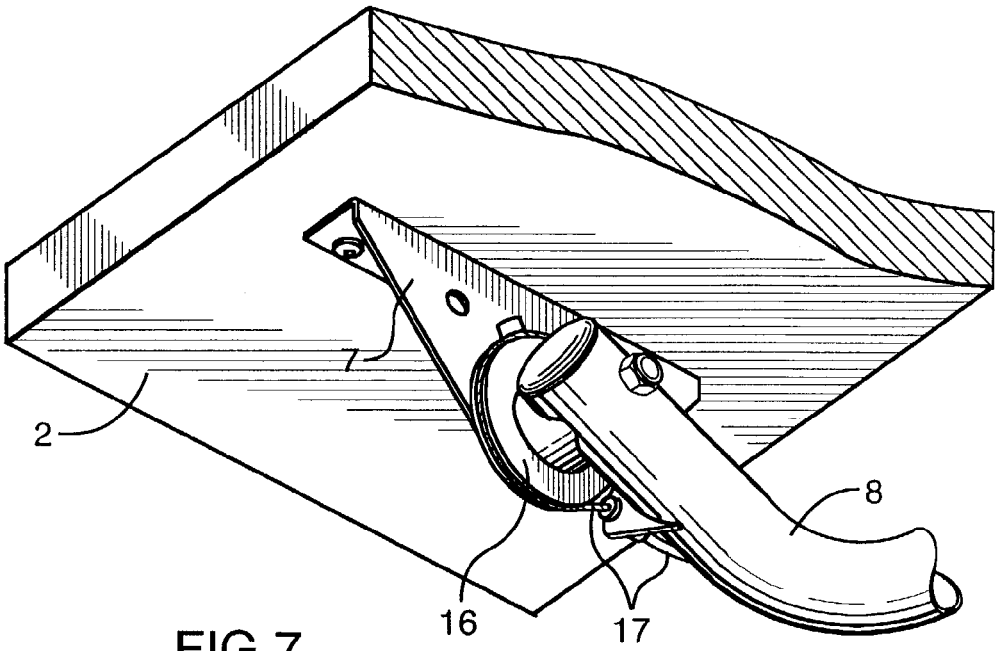
FIG. 7 is a perspective detail view from below of the support mechanism according to the invention, showing the attachment of the arm to the secondary work surface and the second disc.
Figure 8:
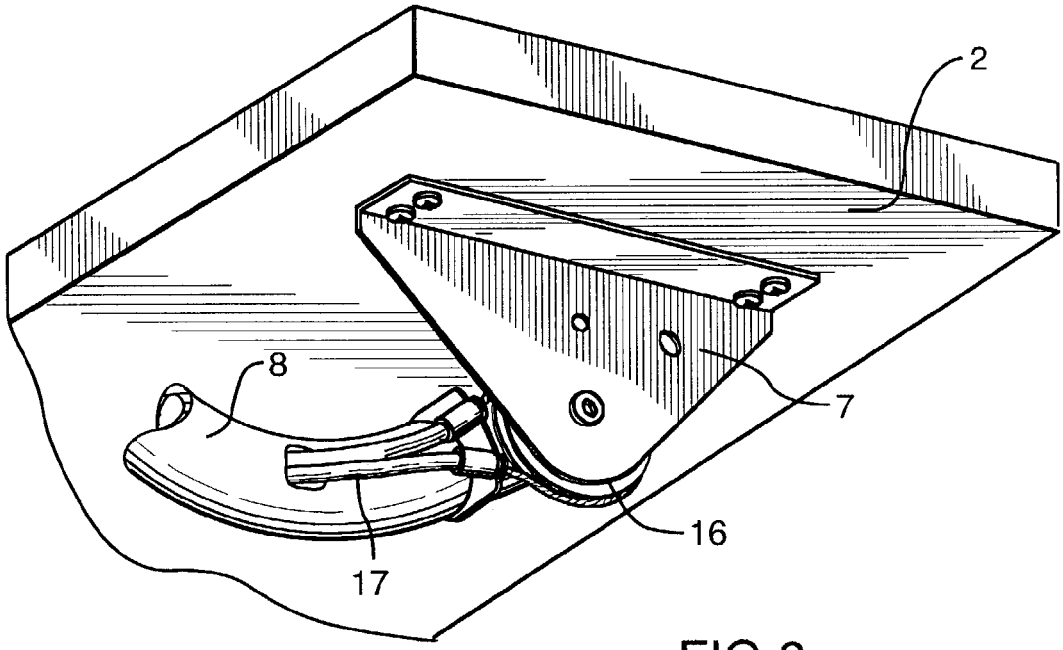
FIG. 8 is a further perspective detail view from below of the support mechanism according to the invention, showing the attachment of the arm to the secondary work surface and the second disc.
Figure 9:
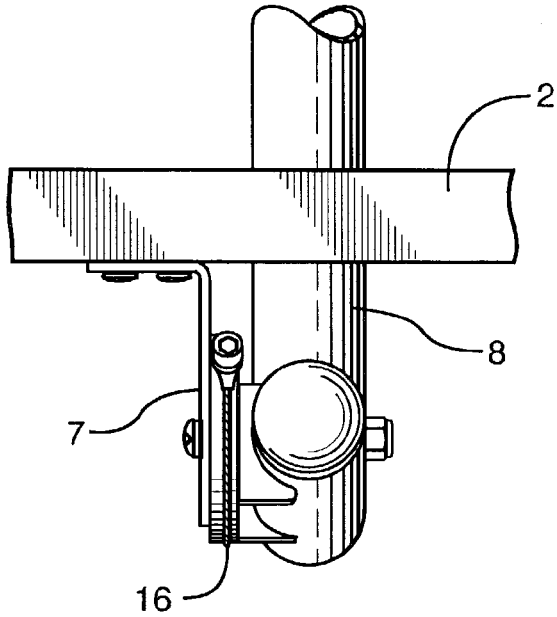
FIG. 9 is a detail plan view of the support mechanism of FIGS. 7 and 8, showing the attachment of the arm to the secondary work surface and the second disc.
Figure 10:
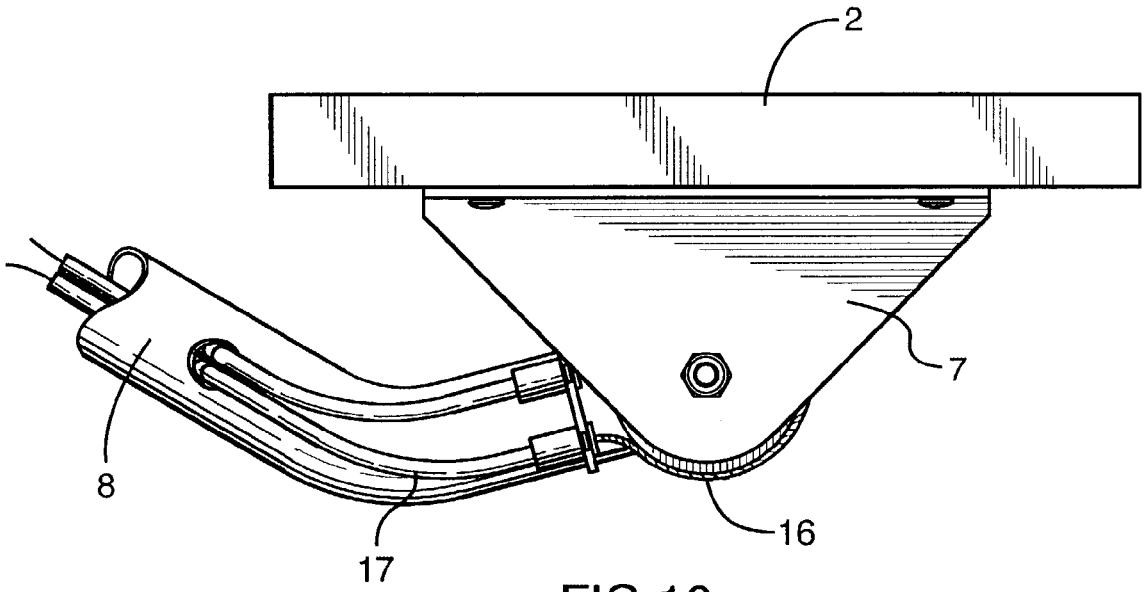
FIG. 10 is a detail end view of the support mechanism of FIG. 9 seen along line 3—3, showing the attachment of the arm to the secondary work surface and the second disc.
Figure 11:
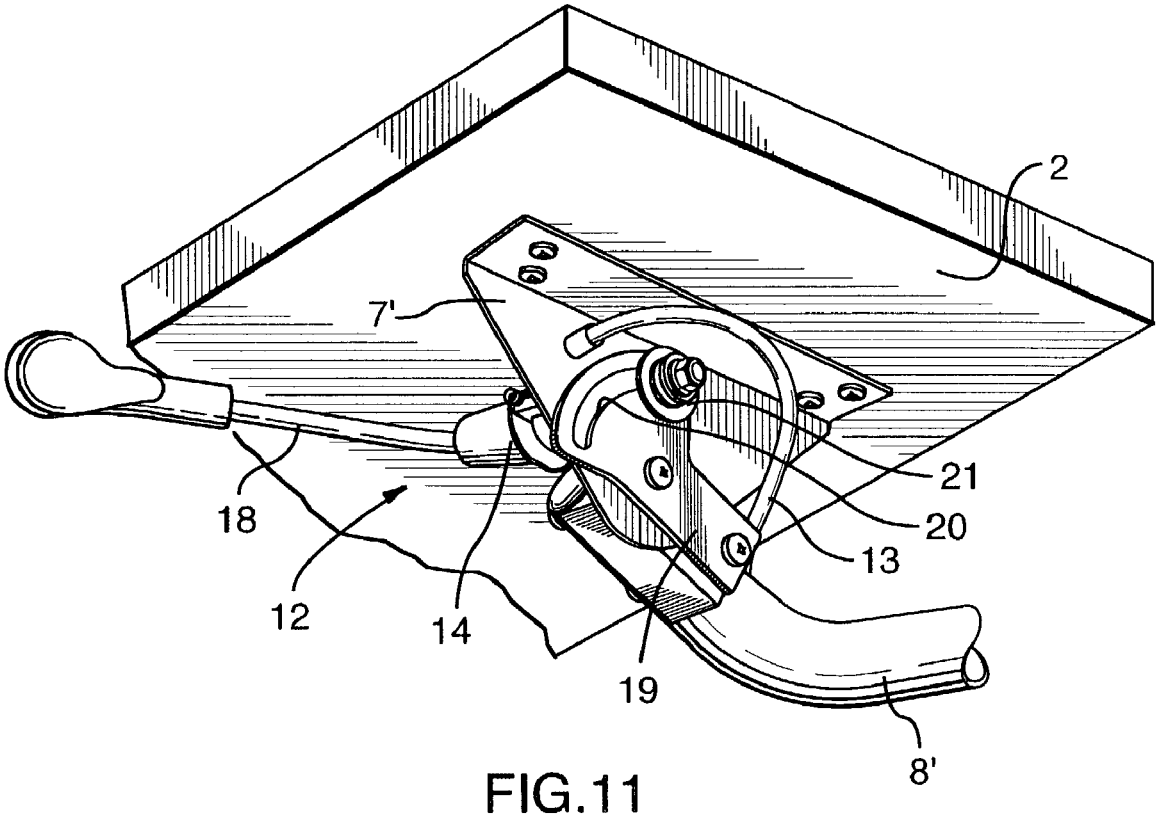
FIG. 11 is a perspective detail view from below of the support mechanism according to the invention, showing the attachment of the arm to the secondary work surface and the tilt brake mechanism and the lever for manipulating both the tilt brake mechanism and the link brake mechanism.
Figure 12:
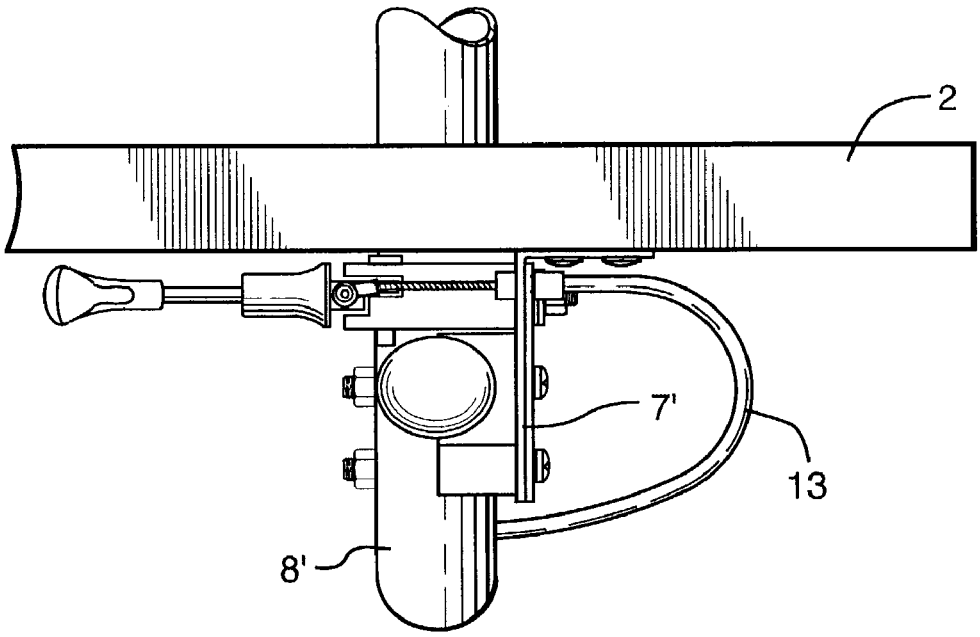
FIG. 12 is a detail plan view of the support mechanism of FIG. 11.
Figure 13:
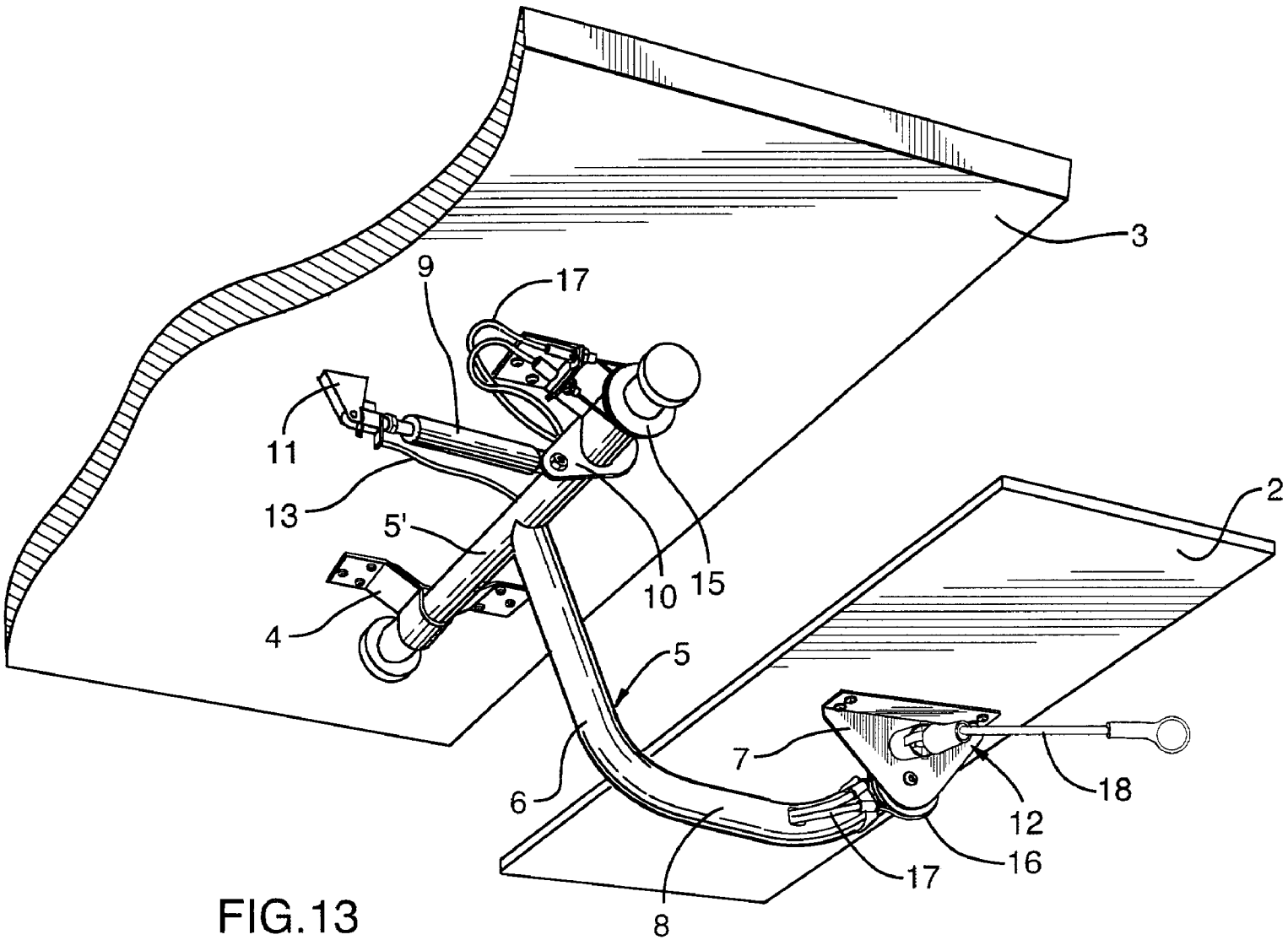
FIG. 13 is a perspective detail view from below of the support mechanism according to a further embodiment of the invention.
Figure 14:
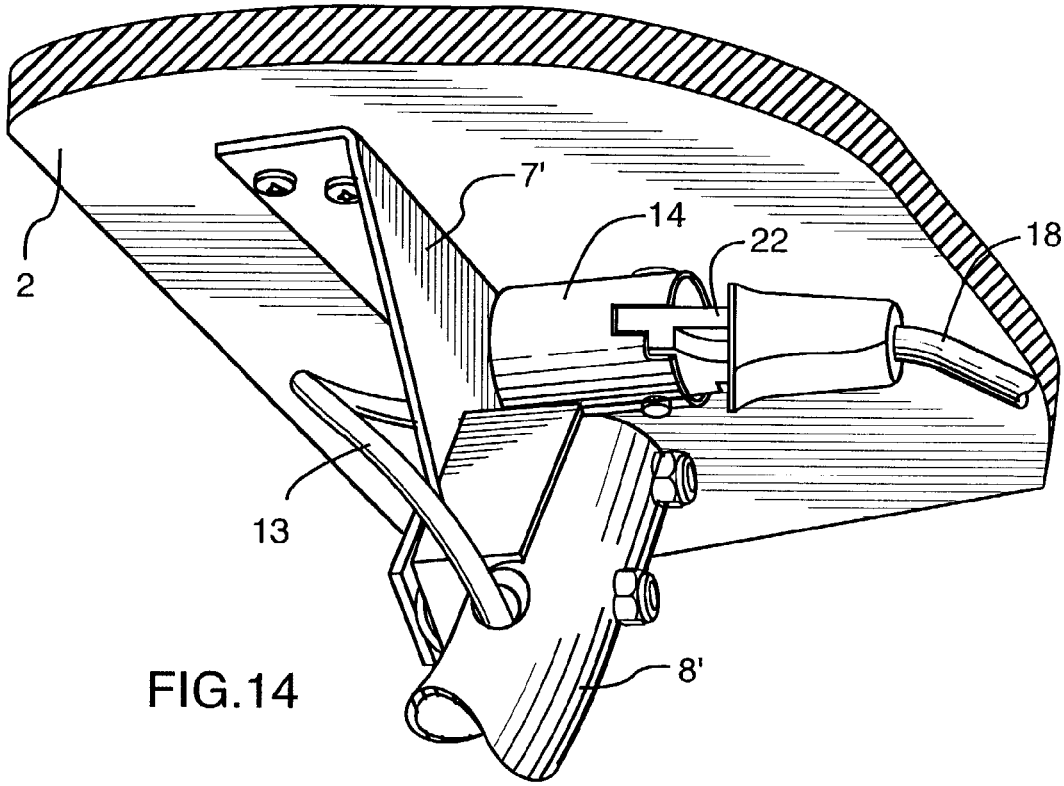
FIG. 14 is a perspective detail view of the tilt brake mechanism as shown in FIG. 11.
Figure 15:
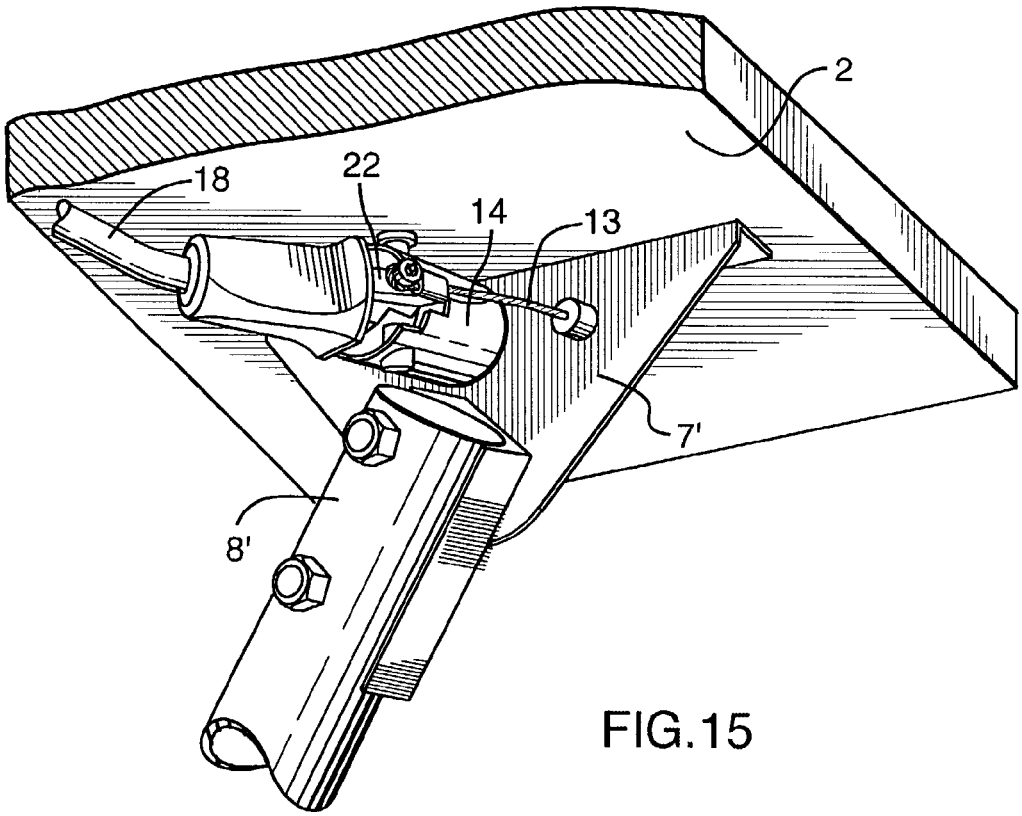
FIG. 15 is a further perspective detail view of the tilt brake mechanism as shown in FIG. 11.

An adjustable work surface support mechanism 1 according to the present invention is provided for mounting a secondary work surface 2 for vertical pivoting movement relative to a primary work surface 3, and for support from the primary work surface. Generally, first mounting bracket 4 attaches a parallel arm 5 to the primary work surface, and second mounting bracket 7, 7', respectively, attaches the arm to the secondary work surface. Two embodiments of the invention are described, a first embodiment as shown in FIGS. 1 to 12 and 14 to 15, and a second embodiment shown in FIG. 13. The difference between the two embodiments is the arm, the first embodiment has double arms, where the arm has a general U-shape, and the second embodiment has one arm extending from a transverse base, thus having a general T-shape. The following description is general to either embodiment, if not noted otherwise.

The arm 5 has a first part 5' attached to the first mounting bracket 4, a second intermediary part 6, 6', respectively, which extends from the first mounting bracket, and a third part 8, 8', respectively, which is attached to the secondary work surface 2. The first mounting bracket defines a first axis about which the arm 5 is pivotable when a link brake mechanism 9 is disengaged, but which link brake mechanism securely holds the linkage arm in a fixed position relative the primary work surface when the link brake mechanism is engaged (braking). A first link brake mechanism attachment bracket 10 is arranged on the first part 5' of the arm 5, and a second brake mechanism attachment bracket 11 is attached to the primary work surface 3. The link brake mechanism is advantageously manipulated via a remote control mechanism 12 advantageously attached to the secondary work surface 2, so that a user of the adjustable work surface support mechanism according to the invention can adjust the pivoting position of the arm 5 relative the primary work surface 3 easily from a position adjacent the secondary work surface. The remote control mechanism advantageously also manipulates a tilt brake mechanism 14 arranged on the secondary work surface 2. The tilt brake mechanism has a tilt bracket 19 having a slot 20 to permit a brake stop 21 to slide in the slot and a lever 18 for selectively releasing or engaging the tilt brake mechanism by not clamping or clamping the brake stop from sliding movement in the slot. The lever is further connected to the brake mechanism 9 via a cable 13, or other movement transmitting means. Examples of advantageous brake mechanisms are spring brakes and gas cylinder brakes, especially counterbalanced brake arrangements. The counterbalancing feature constrains the downwards motion of the arm 5, and thus of the attached secondary work surface, when the brake mechanism is released. The lever 18 thus operates both the tilt brake mechanism 14 and the link brake mechanism 9 simultaneously between disengaged and engaged positions. The lever operates a pinching mechanism 22, which selectively pinches the tilt bracket 19 between the brake stop 21 and the second mounting bracket 7'.

The second mounting bracket 7, 7', respectively defines a second axis about which the secondary work surface 2 is pivotable relative the arm 5, to any position desired by the user. The tilt locking mechanism 14 holds the secondary work surface in the desired pivoted position, when the tilt locking mechanism is in its locked position, and permits the pivoting movement when the tilt locking mechanism is in a released position. Examples of tilt locking mechanisms are friction brake mechanisms (as shown) and ratchet mechanisms.

The secondary work surface 2 is thus pivotable to positions above or below the primary work surface 3, as the need of the user dictates. The arm 5 is advantageously of a one-piece tubular construction, allowing, for instance, the actuating cable 13 of the remote control mechanism 12 to be located inside the arm.

To keep the secondary work surface 2 in the same angle position relative the primary work surface 3 as has been set by the user with the help of the locking mechanism 14, a cable grooved disc system is utilized in the present invention. A first disc 15 is arranged on the first axis (the first part 5' of the arm 5) and rotates with the arm as it rotates about the first axis. A second disc 16 is arranged on the second axis (the second mounting bracket 7, 7') and rotates with the secondary work surface, when the secondary work surface is pivoted. A cable loop 17 is run over the first disc 15 at one end and over the second disc 16 at an opposite end, so that any rotation of the first disc is transmitted to the second disc, in the same direction of rotation. Thus, when the arm 5 is rotated about the first axis, the first disc rotates a certain angle in a first direction of rotation. The cable loop 17 transmits this rotation to the second disc, so that the secondary work surface 2 is kept at substantially the same angular relationship to the primary work surface 3 as before the arm 5 was rotated/pivoted.

The cable loop 17 is arranged with a certain slack around the second disc 16, to allow for a controlled amount of tilting of the secondary work surface 2, when the tilt brake mechanism 14 is disengaged. The amount of slack, compared to a cable loop being looped tight around the second disc, decides the amount of tilting movement possible for the secondary work surface in the following way. Thus, when the secondary work surface is tilted, the slack of the cable loop is gradually stretched in the direction of tilting movement, by the cable loop being caught in the groove of the second disc and held by frictional forces, provided the amount of slack is not great enough to not allow any frictional contact between the cable loop and the second disc. When the available amount of slack has been "used up", i.e. the cable is stretched fully in the direction of tilting movement, the cable acts as a stop for further tilting of the secondary work surface in the same direction. A user manipulating the secondary work surface by tilting it, does not exert enough force to actually pull the cable loop over the first disc to cause the first end of the link system to pivot relative the primary work surface. The slack of the cable loop thus acts as a tilt stop in either tilt direction, and is also not dependent upon the pivoting position of the first end of the link system, the tilt stop allows the same angular tilt of the secondary work surface irrespective of the pivotal position of the link system, because the cable loop is rotated together with the first disc 15 and the second disc 16 during pivoting of the first end of the link system.

The cable loop 17 is advantageously at least partly arranged inside the tubular arm 5, to avoid injury to the user's legs and to protect the cable loop from being damaged. Also advantageously, the actuator for the link brake mechanism 12 and the actuator for the tilt brake mechanism 14 is arranged as one lever 18 attached to the secondary work surface 2, for instance under the secondary work surface adjacent the second mounting bracket and the second disc.

It will be appreciated that the above description relates to the preferred embodiments by way of example only. Many variations on the invention will be obvious to those knowledgeable in the field, and such obvious variations are within the scope of the invention as described and claimed whether or not expressly described.

What is claimed is:

1. An adjustable work surface mechanism for use with a primary work surface and a secondary work surface, comprising:

a link system, adapted to be pivotably attached at a first end to the primary work surface and adapted to be pivotably attached at a second end to the secondary work surface, to permit said secondary work surface to be displaced relative to said primary work surface;

a link brake system arranged to selectably prevent or permit pivoting of said first end of said link system;

a tilt mechanism adapted to mechanically connect said primary work surface and said secondary work surface so that when said first end of said link system is pivoted about a first axis, an angular position of said secondary work surface with respect to said primary work surface is kept substantially constant; and a tilt brake mechanism adapted to selectably prevent or permit tilting of said secondary work surface relative said second end, said tilt mechanism adapted to prevent said second work surface from tilting relative to the primary work surface when said tilt brake mechanism is in an engaged position and adapted to permit said second work surface to tilt when said tilt brake mechanism is in a disengaged position;

said tilt mechanism having a tilt stop mechanism adapted to be arranged on said secondary work surface, to adjustably limit said pivoting of said secondary work surface between end positions and having a first disc and a second disc held in rotational cooperation by a loop, said secondary work surface being pivotable about a second axis, said first disc being rotatable about said first axis and attached to said first end, and said second disc being rotatable about said second axis and adapted to be linked to said secondary work surface, so that when said first end of said link system is pivoted about said first axis, said angular position is kept substantially constant by said second disc being rotated by said first disc via said loop, and said tilt stop mechanism comprising said loop being loosely arranged around said second disc, so that a slack is created in said loop, said slack being gradually stretched in a direction of tilting of said secondary work surface, by said loop being caught in a groove of said second disc and held by frictional forces, so that, when said slack is stretched fully in said direction of tilting, said loop prevents further tilting of said secondary work surface in said direction of tilting.

2. The adjustable work surface arrangement as recited in claim 1, wherein said link system has one arm attached between said first end and said second end.

3. The adjustable work surface arrangement as recited in claim 2, wherein said arm has a hollow shape, and said loop is arranged inside said arm.

4. The adjustable work surface arrangement as recited in claim 3, wherein said link brake mechanism and said tilt brake mechanism are operated simultaneously using a remote control mechanism.

5. The adjustable work surface arrangement as recited in claim 4, wherein said remote control mechanism has a movement transmitting means arranged inside said arm.

6. The adjustable work surface arrangement as recited in claim 1, where said link system has dual spaced apart arms attached between said first end and said second end.

7. The adjustable work surface arrangement as recited in claim 6, wherein said arms have a hollow shape, and said loop is arranged inside one of said arms.

8. The adjustable work surface arrangement as recited in claim 7, wherein said link brake mechanism and said tilt brake mechanism are operated simultaneously using a remote control mechanism.

9. The adjustable work surface arrangement as recited in claim 8, wherein said remote control mechanism has a movement transmitting means arranged inside said arm.

* * * * *